United States Patent [19]

Pratt et al.

[11] Patent Number: 5,043,056

[45] Date of Patent: Aug. 27, 1991

[54] SUPPRESSING SEDIMENT FORMATION IN AN EBULLATED BED PROCESS

[75] Inventors: Roy E. Pratt, Port Neches, Tex.; Jitendra A. Patel, Wappingers Falls, N.Y.

[73] Assignee: Texaco, Inc., White Plains, N.Y.

[21] Appl. No.: 314,867

[22] Filed: Feb. 24, 1989

[51] Int. Cl.[5] ..... C10G 47/00; C10G 47/06; C10G 47/26

[52] U.S. Cl. ..... 208/108; 208/112; 208/162; 208/177

[58] Field of Search ..... 208/108, 112, 162, 177, 208/DIG. 1, 48 AA, 215, 216 R, 217, 85

[56] References Cited

U.S. PATENT DOCUMENTS

| | | | |
|---|---|---|---|
| 3,188,286 | 6/1965 | Van Driesen | 208/112 |
| 3,564,067 | 2/1971 | Brenner et al. | 208/48 AA |
| 3,841,981 | 10/1974 | Layng | 208/112 |
| 3,926,784 | 12/1975 | Christman et al. | 208/210 |
| 4,139,453 | 2/1979 | Hutchings | 208/213 |
| 4,443,330 | 4/1984 | Nongbri | 208/112 |
| 4,446,002 | 5/1984 | Siegmund | 208/45 AA |
| 4,465,584 | 8/1984 | Effron et al. | 208/89 |
| 4,547,285 | 10/1985 | Miller | 208/215 |
| 4,732,664 | 3/1988 | Solari Martini | 208/177 |

*Primary Examiner*—Anthony McFarlane

*Attorney, Agent, or Firm*—Jack H. Park; Kenneth R. Priem; Richard A. Morgan

[57] ABSTRACT

In an ebullated bed process, a residual hydrocarbon oil and a hydrogen containing gas is passed upwardly through an ebullated bed of catalyst in a hydrocracking zone at a temperature in the range of 650° F. to 950° F. and pressure of 1000 psia to 5000 psia. The hydrogen containing gas comprises hydrogen sulfide in an amount to maintain the sulfur content of the oil in the hydrocracking zone at 2 wt % to 10 wt %. A hydrocracked oil is recovered characterized by having a reduced sediment content.

5 Claims, No Drawings

SUPPRESSING SEDIMENT FORMATION IN AN EBULLATED BED PROCESS

BACKGROUND OF THE INVENTION

1. Field of the Invention

This invention relates to an improved ebullated bed process. In the improved process a hydrogen-containing gas comprising elevated amounts of hydrogen sulfide is introduced into the reactor and as a result sediment formation is surpressed.

2. Description of Other Relevant Methods in the Field

The ebullated bed process comprises the passing of concurrently flowing streams of liquids or slurries of liquids and solids and gas through a vertically cylindrical vessel containing catalyst. The catalyst is placed in random motion in the liquid and has a gross volume dispersed through the liquid medium greater than the volume of the catalyst when stationary. The ebullated bed process has found commercial application in the upgrading of heavy liquid hydrocarbons such as vacuum residuum or atmospheric residuum or converting coal to synthetic oils. The ebullated bed process is generally described in U. S. Pat. No. Re. 25,770 issued Apr. 27, 1965 to E. S. Johanson.

U. S. Pat. No. 4,465,584 to E. Effron et al teaches the use of hydrogen sulfide to reduce the viscosity of a bottoms stream produced in a hydroconversion process. Coal, petroleum residuum and similar carbonaceous feed materials are subjected to hydroconversion in the presence of a hydrogen-containing gas to produce a hydroconversion effluent which is subjected to separation to yield a heavy bottoms stream containing high molecular weight liquids and unconverted carbonaceous material. The viscosity of the bottoms stream produced in the separation stage is prevented from increasing by treating the feed to the separation stage with hydrogen sulfide gas prior to or during separation. The heavy bottoms may be stored in an atmosphere of gaseous hydrogen sulfide in order to prevent polymerization and degradation prior to further processing.

U. S. Pat. No. 4,457,834 to J. Caspers et al teaches an ebullated bed process in which gaseous products are recovered from a catalytic hydrogenation zone. Contaminants such as hydrogen sulfide are removed from the gaseous products to yield a hydrogen gas containing at least 70 vol % hydrogen.

U. S. Pat. No. 3,681,231 to S. B. Alpert et al discloses an ebullated bed process for the production of fuels such as diesel oil. A crude feedstock and an aromatic diluent is passed to an ebullated bed at a temperature of 600° F. to 900° F., pressure of 500 to 5000 psig and a hydrogen partial pressure in the range of 65% to 95% of total pressure. It was found that 20 to 70 vol % of an aromatic diluent having a boiling point in the range of 700° F. t o 1000° F. (heavy gas oil) injected in the feed reduced the amount of insoluble material in the product.

U. S. Pat. No. 4,446,002 to C. W. Siegmund teaches a process for suppressing the precipitation of sediment in unconverted residuum obtained from a virgin residuum conversion process. The process comprises blending the unconverted residuum with an effective amount of a virgin residuum.

SUMMARY OF THE INVENTION

The invention is an improvement in an ebullated bed process which hydrocracks a residual hydrocarbon oil in the presence of a particulate catalyst. The process comprises passing the residual oil, a sulfur containing compound and a hydrogen-containing gas upwardly through a zone of ebullated hydrogenation catalyst at a temperature of 650° F. to 950° F. The pressure is about 1000 psia to 5000 psia and space velocity is 0.1 to 1.5 volume of oil per hour per volume of reactor. A hydrocracked oil reduced in sediment content is recovered.

DETAILED DESCRIPTION OF THE INVENTION

A high boiling range hydrocarbon oil derived from petroleum or coal sources, is catalytically hydrotreated in the presence of relatively large volumes of hydrogen which results in hydrocracking of the oil to fuel boiling range products as well as hydrodesulfurization and metals removal. Hydrocarbon oils particularly susceptible to this catalytic hydrotreatment include vacuum residuum, atmospheric residuum, heavy gas oils, coker gas oils, high gravity crude oils and other high boiling hydrocarbon oil fractions.

These high boiling range hydrocarbon oils contain relatively large quantities of pentane insoluble asphaltenes. These asphaltenes readily agglomerate at the high reactor temperatures of the ebullated bed process causing plugging of catalyst pores and preventing fresh hydrocarbon oil from coming in contact with active catalyst sites. The rapid deactivation of catalyst in the ebullated bed process has been attributed to these asphaltenes. Furthermore, the plugging of downstream equipment is attributed to the agglomeration.

An anomaly has been discovered in the ebullated bed hydrodesulfurization process. It was discovered that feedstocks containing higher amounts of sulfur were hydrocracked at a lower temperature to achieve a selected 1000° F.+ conversion than feedstocks containing lower amounts of sulfur.

U. S. Pat. No. 3,809,644 to A. R. Johnson, et al., incorporated herein by reference, reports that it is an advantage in the ebullated bed process to maintain relatively pure hydrogen feed. It is particularly important to supply hydrogen free of hydrogen sulfide to the reaction zone. The patent reports that the pseudo Reaction Rate Constant K for a hydrodesulfurization reaction in an ebullated bed reactor is a function of the hydrogen sulfide concentration in the reactor gas. The reaction rate drops off rapidly with increase in the hydrogen sulfide composition in the reactor gas.

An anomalous region has been found wherein the addition of a sulfur containing compound to the hydrocracking zone yields a hydrocracked hydrocarbon oil product of improved sediment quality at the same desulfurization. That is, that the product oil hydrocracked to the same extent and to equivalent desulfurization demonstrated reduced sediment content.

The sulfur containing compound may be injected into the hydrocarbon oil feedstock prior to hydrocracking, such as by metering in dimethyl sulfide or carbon disulfide. In the preferred embodiment contemplated by inventors, hydrogen sulfide in the hydrogen containing reactor off gas is recycled to the reactor after recompression. By either embodiment, the sulfur containing compound is added in an amount to increase the sulfur content of the hydrocarbon oil in the hydrocracking zone. Preferably, the sulfur containing compound is added in an amount to bring the sulfur content of the oil admixture to about 2 wt % to 10 wt %. The upper limit is set by corrosion tolerance.

The mechanism of the invention is not known with mathematical certainty. It is postulated that the increased sulfur concentration enhances catalytic activity by keeping the active sites fully sulfided in the presence of sulfur scavenging active metals such as nickel, cobalt and molybdenum. This mechanism would explain why equivalent hydrocracking of the feedstock was achieved at lower temperatures. That is because the catalyst is continuously supplied with a fully replenishing amount of sulfiding compound, and each catalytic site is fully sulfided. Hence the transient activity of the catalyst in bulk is maintained at a higher level. This mechanism does not, however, explain the residual suppression of sedimentation.

An alternate mechanism is drawn from U. S. Pat. No. 4,465,584 to Effron et al. incorporated herein by reference. This reference suggests that hydrogen sulfide gas interacts with basic organic groups to reduce condensation and polymerization. This mechanism does not explain the reduction in reactor temperature at equivalent hydrocracking.

The beneficial properties of the instant invention have been determined empirically and are shown by way of Example.

EXAMPLE I

In a two-stage ebullated bed pilot unit sediment content of the bottoms flash drum has been found to correlate with pilot unit operability, with higher sediment contents indicating impending operability problems. The formation of sediment leads to plugging and fouling of equipment downstream from the reactor, causing a shutdown and loss of operating time.

Two test runs were conducted. In the first, the pilot unit was fed sulfur free hydrogen on a one pass basis. In the second test run, hydrogen was recycled and $H_2S$ allowed to concentrate. The following data were taken.

| Run Number | 1 | | 2 | |
|---|---|---|---|---|
| Average Reactor Temp., °F. | 800 | | 800 | |
| LHSV Basis Total Feed, V/hr/V | 0.301 | | 0.295 | |
| $H_2$ Partial Pressure | | | | |
| Inlet, psia | 2438 | | 2574 | |
| Outlet, psia | 2176 | | 2181 | |
| Gas rates, SCFB | Total | $H_2$ | Total | $H_2$ |
| Reactor Feed, gas | 3568 | 3568 | 4326 | 3987 |
| Recycle | — | — | 3962 | 3458 |
| Quench | 894 | 894 | 1068 | 984 |
| Purge | 1200 | 1200 | 1237 | 1140 |
| Reactor Off-Gas Analysis, vol % | | | | |
| $H_2$ | 95.5 | | 87.3* | |
| C1 | 1.7 | | 6.2 | |
| C2 | 0.6 | | 1.8 | |
| C3 | 0.4 | | 0.9 | |
| iC4 | 0.0 | | 0.1 | |
| nC4 | 0.2 | | 0.2 | |
| $H_2S$ | 1.6 | | 3.5 | |
| 1000° F.+ Conversion, vol % | 54.2 | | 58.0 | |
| Btms Flash Drum IP Sediment, wt % | 0.72 | | 0.08 | |

*During gas recycle test run, composition of the recycle gas was the same as the reactor off-gas.
IP Sediment - Total Sediment in Residual Fuel Oil: Institute de Petrole designation IP 375/86
SCFB - Standard cubic feet per barrel
LHSV - Liquid hourly space velocity, volume/hr/volume Hydrogen recycle significantly increased $H_2S$ content of the reactor off-gas with a reduction in sediment content from 0.72 wt % to 0.08 wt %. This was achieved even though the conversion during the recycle gas run was higher than during the once through run. Higher conversion typically increases sediment content.

EXAMPLE II

Vacuum residue feedstocks derived from six different petroleum sources were passed over fresh American Cyansmid HDS-1443B hydrocracking catalyst. The feedstocks were evaluated for susceptibility to hydrocracking, i.e. temperature required to obtain the same selected 1000° F.+ conversion.

The following data were taken:

| Feedstock | Arabian Med/Hvy | Isthmus | Maya | Merey | Oriente | Ratawi |
|---|---|---|---|---|---|---|
| S, wt. % | 5.0 | 4.03 | 5.03 | 3.51 | 2.1 | 6.44 |
| Ni, ppm | 49 | 73 | 116 | 115 | 124 | 54 |
| V, ppm | 134 | 321 | 549 | 476 | 253 | 111 |
| Total, Ni+V | 183 | 394 | 665 | 591 | 377 | 165 |
| n-C5 insolubles | 28.4 | 30.59 | 33.4 | 35.06 | 33.1 | 36.71 |

| | Temperature | 1000° F.+ Conversion | Pound sulfur removed per 100 pound feed at 70% desulfurization | sulfide partial pressure with reference to Oriente |
|---|---|---|---|---|
| Ratawi | 780° F. | 58.2% | 4.51 | 307% |
| Arabian M/H | 780° F. | 58.2% | 3.50 | 238% |
| Maya | — | — | 3.52 | 239% |
| Isthmus | 780° F. | 47.9% | 2.82 | 192% |
| Merey | 780° F. | 48.2% | 2.45 | 167% |
| Oriente | — | — | 1.47 | — |

Vacuum residuum samples from five crude petroleum sources were run on a pilot ebullated bed. The following data were recorded:

| Feedstock: | Merey | Ratawi | Isthmus | Arabian MED/HVY | Alaskan North Slope |
|---|---|---|---|---|---|
| Avg. Rx Temp, °F. | 780 | 780 | 780 | 780 | 775 |
| Catalyst Age, bbl/lb | 1.4 | 1.2 | 1.0 | 1.1 | 1.5 |
| 1000° F.+ Conv, vol % | 48.2 | 58.2 | 47.9 | 58.2 | 44.2 |
| Hydrodesulfurization, wt % | 56.2 | 71.8 | 68.4 | 73.7 | 72.2 |
| Hydrodenitrogenation, wt % | 22.0 | 32.9 | 34.3 | 42.9 | 27.7 |
| Micro Carbon Res. Redn, wt % | 45.1 | 58.6 | 49.9 | 58.1 | 50.9 |
| Nickel Removal, wt % | 62.9 | 72.5 | 64.2 | 70.9 | 76.4 |
| Vanadium Removal, wt % | 70.0 | 86.6 | 77.7 | 83.4 | 87.5 |
| Asphaltenes Removal, wt % | 55.0 | 72.8 | 55.1 | 53.1 | 37.1 |
| 1000° F.+ nC5 Insol, wt % | 35.2 | 30.9 | 25.4 | 26.0 | 16.0 |
| 1000° F.+ nC7 Insol, wt % | 16.6 | 11.1 | 10.8 | 12.6 | 5.43 |
| 1000° F.+ Toluene Insol, wt % | 0.32 | 0.01 | 0.20 | 0.17 | — |
| Feed Sulfur, wt % | 3.51 | 6.44 | 4.03 | 5.0 | 2.30 |
| Removed lb S/100 lb. feed | 1.97 | 4.62 | 2.75 | 3.68 | 1.66 |

While particular embodiments of the invention have been described, it will be understood, of course, that the invention is not limited thereto since many modifications may be made, and it is, therefore, contemplated to cover by the appended claims any such modifications as fall within the true spirit and scope of the invention.

What is claimed is:

1. A method for hydrocracking a residual hydrocarbon oil characterized in having amounts of pentane insoluble asphaltenes, the steps comprising:

introducing the residual hydrocarbon oil and a hydrogen containing gas into an ebullated bed of particulate catalyst, adding a sulfur containing compound to form an oil-hydrogen-sulfur admixture wherein said sulfur containing compound is added in an amount to elevate the sulfur content of the admixture to about 2 wt % to 10 wt %, hydrocracking the admixture in the ebullated bed at a temperature in the range of about 650° F. to 950° F. and pressure in the range of about 1000 psia to 5000 psia, recovering a hydrocracked oil characterized in having a reduced sediment content.

2. The method of claim 1 wherein the sulfur containing compound yields hydrogen sulfide.

3. The method of claim 1 wherein the sulfur containing compound is selected from the group consisting of hydrogen sulfide, dimethyl sulfide and carbon disulfide.

4. The method of claim 1 wherein the sulfur containing compound is introduced to the ebullated bed with the hydrogen containing gas.

5. The method of claim 1 wherein the hydrogen containing gas comprises about 2 vol % to 10 vol % hydrogen sulfide.

* * * * *